US008758090B2

(12) United States Patent
Shao et al.

(10) Patent No.: US 8,758,090 B2
(45) Date of Patent: Jun. 24, 2014

(54) POLISHING METHOD AND POLISHING DEVICE

(75) Inventors: Qun Shao, Shanghai (CN); Li Jiang, Shanghai (CN); Mingqi Li, Shanghai (CN); Qingling Wang, Shanghai (CN)

(73) Assignee: Semiconductor Manufacturing International (Shanghai) Corporation, Shanghai (CN)

( * ) Notice: Subject to any disclaimer, the term of this patent is extended or adjusted under 35 U.S.C. 154(b) by 265 days.

(21) Appl. No.: 13/328,846

(22) Filed: Dec. 16, 2011

(65) Prior Publication Data

US 2012/0190278 A1 Jul. 26, 2012

(30) Foreign Application Priority Data

Jan. 20, 2011 (CN) ..... 2011 1 0023376

(51) Int. Cl.
*B24B 37/04* (2012.01)

(52) U.S. Cl.
USPC ..... 451/36; 451/41; 451/57; 451/288; 438/692; 156/345.12; 257/E21.23; 216/89

(58) Field of Classification Search
USPC ..... 451/36, 41, 57, 63, 67, 104, 106, 113, 451/285, 287, 288; 438/691, 692; 156/345.12; 257/E21.23; 216/89
See application file for complete search history.

(56) References Cited

U.S. PATENT DOCUMENTS

| | | | | |
|---|---|---|---|---|
| 4,821,466 | A * | 4/1989 | Kato et al. | 451/36 |
| 5,449,313 | A * | 9/1995 | Kordonsky et al. | 451/35 |
| 5,575,706 | A * | 11/1996 | Tsai et al. | 438/693 |
| 5,876,508 | A * | 3/1999 | Wu et al. | 134/2 |
| 6,297,159 | B1 * | 10/2001 | Paton | 438/693 |
| 6,489,243 | B2 * | 12/2002 | Kojima et al. | 438/691 |
| 6,576,552 | B2 * | 6/2003 | Kojima et al. | 438/691 |
| 7,416,942 | B2 * | 8/2008 | Matsui et al. | 438/257 |
| 2001/0044271 | A1 | 11/2001 | Walker et al. | |
| 2002/0098698 | A1 * | 7/2002 | Kojima et al. | 438/691 |
| 2008/0051008 | A1 * | 2/2008 | Economikos et al. | 451/8 |

* cited by examiner

*Primary Examiner* — Eileen P. Morgan
(74) *Attorney, Agent, or Firm* — Anova Law Group, PLLC

(57) ABSTRACT

A polishing method includes: mounting a wafer on a fixed abrasive polishing pad located on a polishing platen; delivering a polishing slurry to the fixed abrasive polishing pad to polish the wafer; and adsorbing abrasive particles generated during the polishing process with an electrode. The electrode has a polarity opposite to a polarity of charges of the abrasive particles. A polishing device includes a polishing platen, a fixed abrasive polishing pad, a slurry pipeline and a polarity changer having an electrode. Therefore, the abrasive particles generated during the polishing process are removed, which prevents the wafer from being scratched, thereby increasing wafer yield and improving efficiency.

14 Claims, 5 Drawing Sheets

POLISHING METHOD AND POLISHING DEVICE

CROSS REFERENCE TO RELATED APPLICATIONS

The present application claims the priority of Chinese Patent Application No. 201110023376.0, entitled "Polishing Method and Polishing Device", and filed on Jan. 20, 2011, the entire disclosure of which is incorporated herein by reference.

FIELD OF THE INVENTION

The present invention generally relates to semiconductor manufacturing process, and more particularly, to a polishing method and a polishing device.

BACKGROUND OF THE INVENTION

In semiconductor manufacturing field, planarizing a wafer is one of the important processes for fabricating a semiconductor device. In conventional art, chemical mechanical polishing (CMP) is a kind of process used for planarizing a surface of a semiconductor wafer, which combines the effects of mechanical force with the chemical reaction generated between the wafer surface and the polishing slurry. Another kind of process for planarizing a wafer surface is fixed abrasive polishing. For instance, U.S. Patent Publication NO. 20010044271 discloses a polishing pad which is formed by fixing an abrasive layer having a plurality of abrasive particles to a rigid layer. The polishing pad is mounted on a polishing platen, which includes a surface in contact with a surface of a wafer.

However, in the conventional CMP process, the polishing slurry distributes randomly on the polishing pad, which induces lots of negative problems such as an uneven density, a poor polishing result, a low utilization ratio of the slurry, and environmental pollution caused by wasted polishing slurry. Therefore, the CMP process tends to be replaced with the fixed abrasive polishing process which has advantages such as a high utilization ratio of the abrasives and an excellent polishing precision, and becomes more widely used in semiconductor manufacturing process.

FIGS. 1*a* and 1*b* are schematic cross-sectional views illustrating operating states of a fixed abrasive polishing system according to the prior art. Referring to FIG. 1*a*, a fixed abrasive polishing pad 102 which includes an abrasive layer is fixed on a polishing platen 101. The abrasive layer includes a plurality of abrasive blocks formed by solidifying the abrasives. A wafer 103 is fixed to a polishing head 104, and a surface of the wafer is in contact with the abrasive layer on the polishing pad 102. In operation, the fixed abrasive polishing pad 102 is driven to rotate by the rotation of the polishing platen 101. And the wafer 103 is driven to rotate by the rotation of the polishing head 104 and moves relative to the fixed abrasive polishing pad 102, which makes the surface of the wafer 103 rub against the abrasive layer to be polished. Referring to FIG. 1*b*, because the abrasive layer 110 formed on the fixed abrasive polishing pad 102 includes solid particles such as silica and ceria, a large number of solid particles such as silica particles 201 and ceria particles 202, are then generated by the mechanical force when the abrasive layer 110 is rubbed against the surface of the wafer 103. The solid particles have an unintended impact on the polishing performance, causing the surface of the wafer 103 scratched. As a result, the wafer is damaged and scraped. Deionized water is commonly used to rinse and wash the surface of the fixed abrasive polishing pad 102 after the wafer is polished, so as to remove the solid particles generated during the polishing process, thereby reducing the risk of scratch damage to a next wafer. However, the conventional process can not absolutely prevent damages to the wafer caused by the solid particles generated during the polishing process.

SUMMARY OF THE INVENTION

Embodiments of the present invention provide a polishing method alleviating damages to a wafer, to obviate the disadvantage associated with the prior art that abrasive particles which are generated during the fixed abrasive polishing process may causes the wafer damaged and scraped, resulting in reduction in wafer yield and poor efficiency.

One embodiment of the present invention provides a polishing method. The method includes:

mounting a wafer on a fixed abrasive polishing pad located on a polishing platen;

delivering a polishing slurry to the fixed abrasive polishing pad to polish the wafer; and adsorbing abrasive particles generated during the polishing process with an electrode, wherein the electrode has a polarity opposite to a polarity of charges of the abrasive particles.

Optionally, the polishing slurry includes one or more materials selected from a group consisting of proline, alanine, and glycine.

Optionally, the polishing slurry includes a PH value ranging from about 10 to about 11.

Optionally, the abrasive particles include silica particles or ceria particles.

Another embodiment of the present invention provides a polishing device. The device includes:

a polishing platen;

a fixed abrasive polishing pad located on the polishing platen;

a slurry pipeline for transmitting a polishing slurry to the fixed abrasive polishing pad in a polishing process; and a polarity changer having an electrode which is configured above the fixed abrasive polishing pad in a polishing process, wherein the polarity changer is out of contact with the fixed abrasive polishing pad and the electrode is in contact with the polishing slurry when the electrode is in operation.

Optionally, the polishing device further includes a cleaning device and a power source, wherein the cleaning device is fixed to one side of the polishing platen via a base and is coupled to one end of the power source via a switch, and the polarity changer is coupled to the other end of the power source via the switch.

Optionally, the power source includes a voltage ranging from about 0V to about 30V.

Optionally, the electrode includes non-conductive materials.

Optionally, the surface of the electrode is coated with a metal film.

Optionally, the electrode includes conductive materials.

Optionally, the surface of the electrode is coated with an insulating film.

Optionally, the electrode has a shape of cylinder or elongated rod.

Optionally, the polishing slurry transmitted by the slurry pipeline includes an alkaline solution.

Optionally, one end of the power source is coupled to the polarity changer via the switch, and the other end of the power source is coupled to the polishing platen via the switch when the electrode is in operation.

Compared with the prior art, this invention has the following advantages:

In the polishing process, a polarity changer having an electrode is configured above a fixed abrasive polishing pad, which is out of contact with the fixed abrasive polishing pad, whereas the electrode is in contact with the polishing slurry. The electrode has a polarity opposite to the polarity of charges of the abrasive particles so as to adsorb abrasive particles generated during the polishing process. Because the abrasive particles which include silica particles and ceria particles have a relatively lower isoelectric point, the abrasive particles are thus negatively charged when immersed in an alkaline solution. Whereas, the electrode is positively charged. Accordingly, the abrasive particles can be adsorbed by the electrode by the attraction of opposite charges. The abrasive particles generated during the polishing process can be removed, which prevents the wafer from being damaged and scraped and improves wafer yield and efficiency of the polishing.

DETAILED DESCRIPTION OF THE EMBODIMENTS

In a conventional fixed abrasive polishing process, an abrasive layer on a fixed abrasive polishing pad is formed by solidifying abrasive particles such as silica or ceria particles. During the polishing process, due to the shearing force in transverse and longitudinal directions induced by friction and extrusion against the wafer surface, some abrasive particles gradually dissociate from the abrasive layer. As the polishing process goes on, more and more abrasive particles dissociate, which are more likely to scratch the wafer surface. Deionized water is commonly used to rinse and wash the surface of the fixed abrasive polishing pad after the wafer is polished, so as to remove the solid particles generated during the polishing process, thereby reducing the risk of scratch damages to the next wafer to be polished. However, the conventional process can not effectively prevent damages to the wafer surface caused by the solid particles during the polishing process.

Figure 1A:
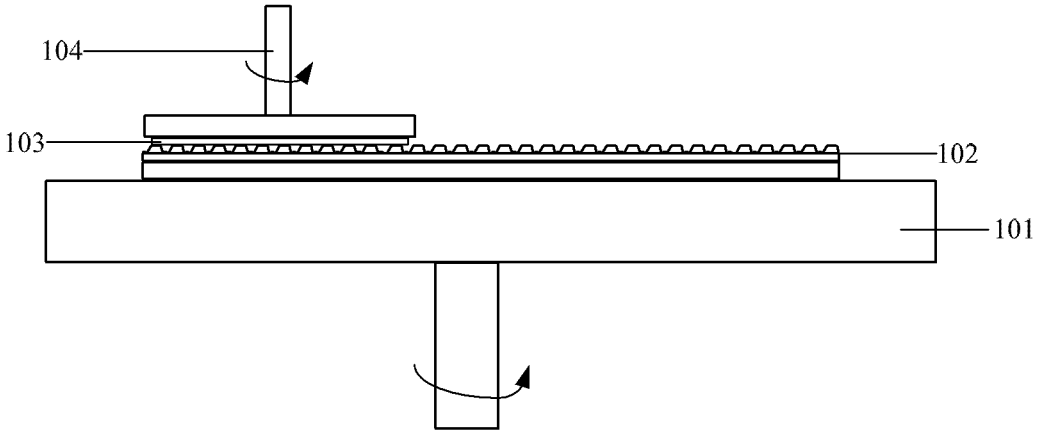
Fig. 1a (prior art)
FIGS. 1*a* and 1*b* are schematic cross-sectional views illustrating operating states of a fixed abrasive polishing process according to the prior art.
Figure 1B:
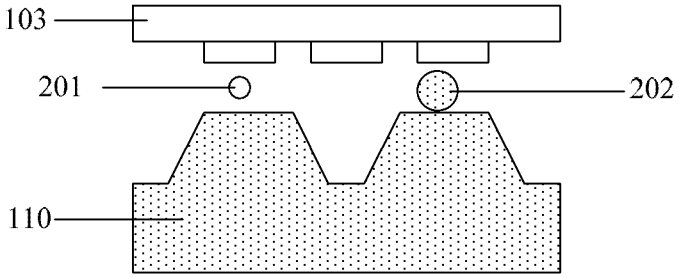
Fig. 1b (prior art)
Figure 2:
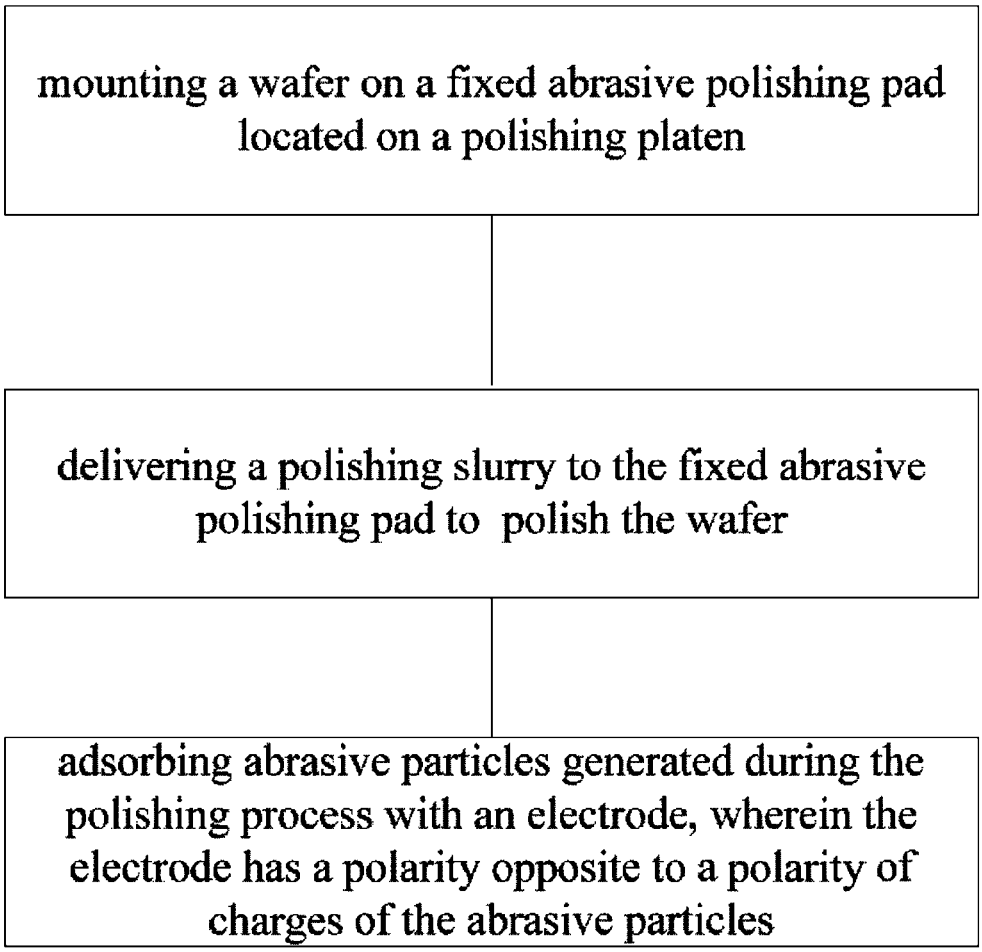
FIG. 2 is a flow chart of a polishing method according to the present invention.

In order to solve the problems described above, one embodiment of the present invention provides a polishing method. Referring to FIG. 2, the polishing method includes the steps:

S11, mounting a wafer on a fixed abrasive polishing pad located on a polishing platen;

S12, delivering a polishing slurry to the fixed abrasive polishing pad to polish the wafer; and S13, adsorbing abrasive particles generated during the polishing process with an electrode, wherein the electrode has a polarity opposite to a polarity of charges of the abrasive particles.

Because the abrasive particles generated in the fixed abrasive polishing process mainly include silica particles or ceria particles, which have a relatively lower isoelectric point, the abrasive particles have negative charges when immersed in an alkaline polishing solution. In polishing process, by bringing the electrode having positive charges to contact the polishing slurry, the abrasive particles can be adsorbed by the electrode according to the principle that unlike charges attract each other. Accordingly, the abrasive particles generated during the polishing process can be removed, which prevents the wafer from being damaged and scraped, thereby increasing the yield and improving the efficiency of the polishing process.

Figure 3A:
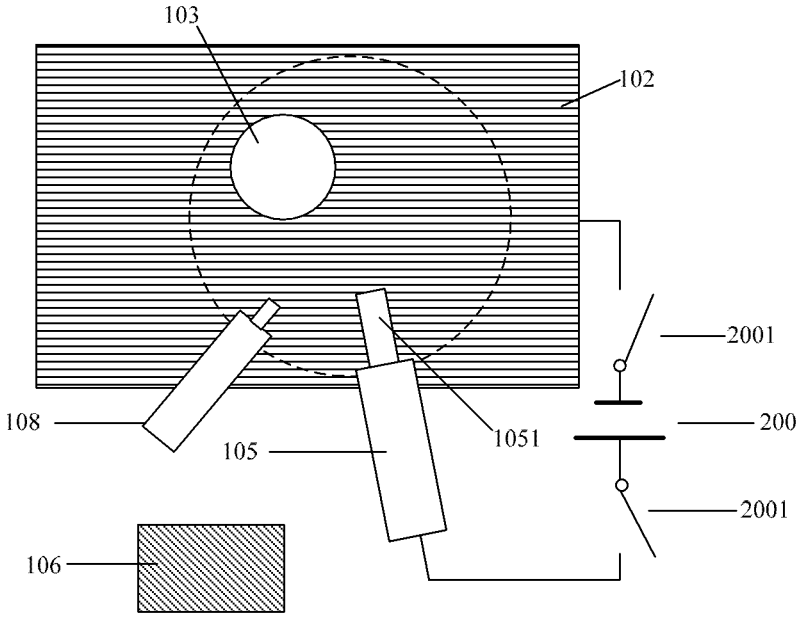
FIGS. 3*a* and 3*b* are schematic top views of a polishing device according to the present invention.
Figure 3B:
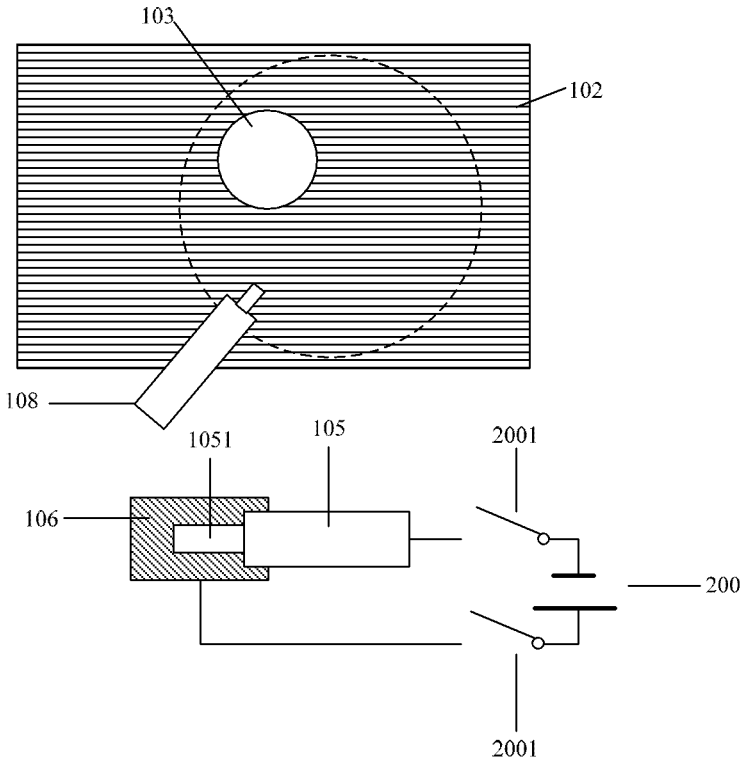

Another embodiment of the present invention provides a polishing device that is applicable to the polishing method in the above embodiment. FIGS. 3*a* and 3*b* are schematic top views of a polishing device according to an embodiment of the present invention. Referring to FIG. 3*a*, a polishing device includes a polishing platen (not shown), a fixed abrasive polishing pad 102, a slurry pipeline 108 and a polarity changer 105. The fixed abrasive polishing pad 102 is transported by an inputting roller together with an outputting roller (not shown) which is fixed to an identical base which is shared with the polishing platen, so that the polishing pad 102 is mounted on the polishing platen. In a polishing process, the fixed abrasive polishing pad 102 is motionless relative to the polishing platen. The slurry pipeline 108 is fixed to a sidewall or a bottom surface of the polishing device by a connecting device (not shown). An outlet of the slurry pipeline 108 is located above the fixed abrasive polishing pad 102 and close to the centre thereof. The polarity changer 105 is fixed beside the polishing platen by a supporting device (not shown). Being flexibly connected to the supporting device, the polarity changer 105 can rotationally move to a position above the fixed abrasive polishing pad 102, which forms a spacing between the polarity changer 105 and the fixed abrasive polishing pad 102. The polarity changer 105 has an electrode 1051 mounted at one end.

In another embodiment, the polishing device further includes a cleaning device 106, a switch 2001 and a power source 200, which are fixed beside the polishing platen by the base (not shown). One end of the power source 200 is coupled to the polarity changer 105 via the switch 2001, and the other end of the power source 200 is coupled to the polishing platen via the switch 2001. The polarity changer 105 can rotationally move to the cleaning device 106.

Referring to FIG. 3*a*, when performing a polishing process, the polarity changer 105 rotationally moves to a position above the fixed abrasive polishing pad 102, and the electrode 1051 is brought into contact with the polishing slurry that is delivered to the fixed abrasive polishing pad 102. The power source 200 supplies power to the polarity changer 105 to allow the electrode 1051 positively charged, which has a polarity opposite to the polarity of charges of the abrasive particles. The abrasive particles can be adsorbed by the electrode 1051 of the polarity changer 105 by the attraction of unlike charges.

Referring to FIG. 3*b*, the polarity changer 105 which has adsorbed abrasive particles rotationally moves to the cleaning device 106. One end of the power source 200 is then connected to the polarity changer 105 via the switch 2001, and the other end of the power source 200 is connected to the cleaning device 106 via the switch 2001. Under this circumstance, the power source 200 supplies reverse voltage to the polarity changer 105 to allow the electrode 1051 negatively charged, which has a polarity identical to the polarity of charges of the abrasive particles. The abrasive particles which have been adsorbed by the electrode 1051 may be cleared away from the electrode 1051 by the repellence of identical charges, and move to the cleaning device 106. Accordingly, the electrode 1051 of the polarity changer 105 is cleaned so as to proceed to adsorb the other abrasive particles.

By using the polishing device of the present invention, it is convenient to charge the electrode 1051 of the polarity changer 105 to have a polarity opposite to the polarity of charges of the abrasive particles by using the power source 200, which facilitates adsorbing the abrasive particles rapidly with the electrode 1051. Afterwards, the polarity changer 105 is moved to the cleaning device 106. The power source 200 supplies reverse voltage to the polarity changer 105 so that the electrode 1051 is charged to have a polarity identical to the polarity of charges of the abrasive particles, thereby removing the abrasive particles adsorbed by the electrode 1051 rapidly, which cleans up the electrode 1051 of the polarity changer 105 for the purpose of subsequent use.

Hereunder, the present invention will be described in detail with reference to embodiments, in conjunction with the accompanying drawings.

Figure 4:
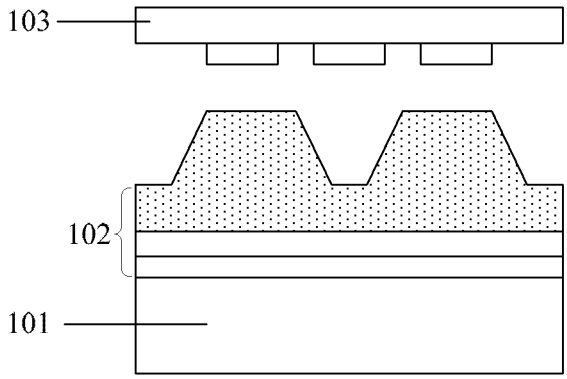
FIGS. 4 to 8 are schematic cross-sectional views illustrating a polishing method according to the present invention.

Referring to FIG. 4, a wafer 103 is mounted on the fixed abrasive polishing pad 102 located on the polishing platen. Specifically, the wafer 103 is fixed to a polishing head (not shown), and the fixed abrasive polishing pad 102 is mounted on the polishing platen 101, which brings a surface of the wafer 103 to be polished into contact with a surface of the fixed abrasive polishing pad 102. A downward force of the polishing head is applied to the wafer 103 which supplies a predetermined polishing pressure to the contact surface between the wafer 103 and the fixed abrasive polishing pad 102.

In an embodiment, the fixed abrasive polishing pad 102 includes a rigid layer, a bonding layer, and an abrasive layer in sequence from bottom to top. The abrasive layer is formed by solidifying abrasive particles such as silica, ceria, aluminium oxide, silicon carbide, boron carbide, zirconia, adamas, and the like. Silica particles and ceria particles are commonly used to form the abrasive particles. The abrasive layer has a surface with a regular concave-convex shape so as to enhance polishing efficiency.

Figure 5:
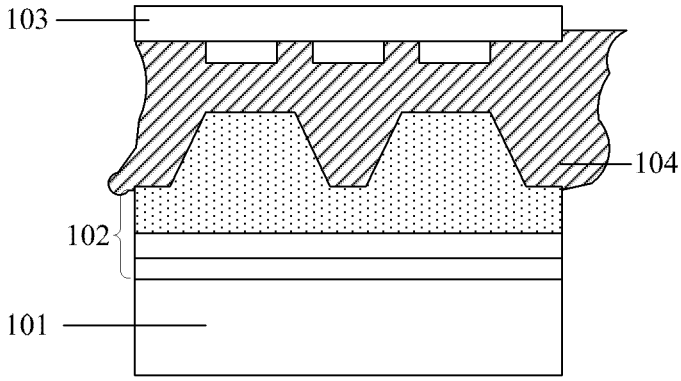

Referring to FIG. 5, a polishing slurry 104 is delivered to the fixed abrasive polishing pad 102 to polish the wafer 103.

The polishing slurry 104 is delivered to the surface of the fixed abrasive polishing pad 102 by a slurry pipeline 108, so that the contact surface between the wafer 103 and the fixed abrasive polishing pad 102 is filled with the polishing slurry 104. The polishing slurry 104 may include one or more materials selected from a group consisting of proline, alanine and glycine, but not limited thereto. The polishing slurry includes a PH value ranging from about 10 to about 11. In an example embodiment, the polishing slurry 104 includes proline and has a PH value of about 10.5.

In operation, the polishing platen is driven to rotate, so that the fixed abrasive polishing pad 102 moves rotationally by the rotation of the polishing platen. And the polishing head is driven to rotate, which rotates the wafer 103 which is fixed to the polishing head rotated. The wafer 103 moves rotationally relative to the fixed abrasive polishing pad 102 to perform a polishing process.

Figure 6:
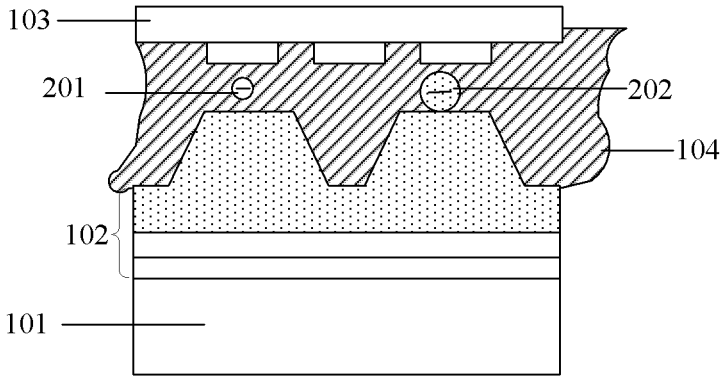

Referring to FIG. 6, abrasive particles 201, 202 are generated between the wafer 103 and the fixed abrasive polishing pad 102 in the polishing process, which are negatively charged in the polishing slurry 104.

In an embodiment, the abrasive layer is in contact with a surface of the wafer 103 during the polishing process, which causes continuous friction and extrusion against each other. By the shearing force in transverse and longitudinal directions induced by friction and extrusion, the surface of the wafer 103 is thus planarized. In terms of interaction forces, the shearing force in transverse and longitudinal directions is also applied to the abrasive layer. Accordingly, a portion of abrasive particles 201, 202, such as silica or ceria particles, gradually dissociate from the abrasive layer, and remain between the wafer 103 and the fixed abrasive polishing pad 102. As the polishing process goes on, the surface of the wafer 103 is more likely to be scratched by the abrasive particles 201, 202.

In an embodiment, the abrasive particles 201, 202 have a relatively lower isoelectric point. For example, silica has an isoelectric point value of about 2.2, and ceria has an isoelectric point value of about 6.8. The term "isoelectric point" used herein means the PH value where the overall net charge of zwitterions is zero. At the isoelectric point the sum of all these charges is zero. The charge of zwitterions may vary with the PH value of a solution. At a PH value above the isoelectric point, the overall net charge of the ions will be negative, whereas at a PH value below the isoelectric point, the overall net charge of the ions will be positive. Because the polishing slurry 104 includes an alkaline solution, the PH value is higher than the isoelectric point of the abrasive particles 201, 202, the abrasive particles 201, 202 immersed in the polishing slurry 104 are thus negatively charged.

Figure 7:
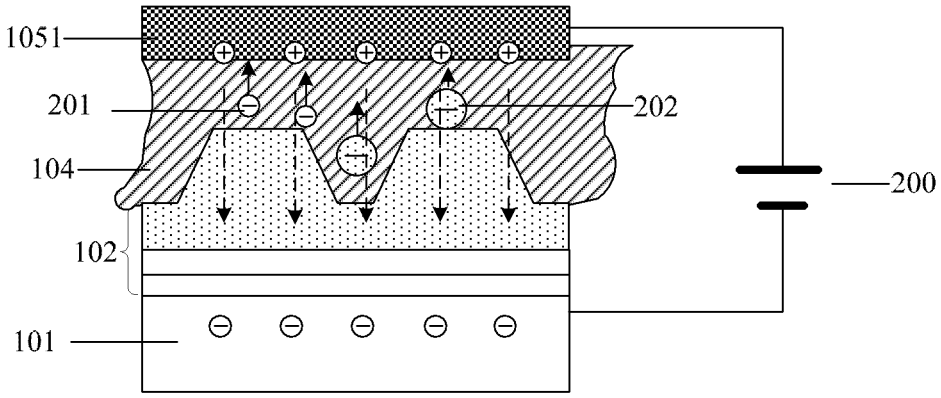

Referring to FIG. 7, abrasive particles generated during the polishing process are adsorbed with an electrode 1051, wherein the electrode 1051 has a polarity opposite to the polarity of charges of the abrasive particles 201, 202.

In an embodiment, the abrasive particles 201, 202 are negatively charged, whereas the electrode 1051 has a positive polarity. The adsorbing process mainly includes the following steps. The polarity changer 105 rotationally moves to a position above the fixed abrasive polishing pad 102, which is out of contact with the fixed abrasive polishing pad. In other words, there is a spacing between the polarity changer 105 and the fixed abrasive polishing pad 102. The electrode 1051 is in contact with the polishing slurry that is delivered to the fixed abrasive polishing pad 102. Positive polarity of the power source 200 is coupled to the electrode 1051 which becomes positively charged. Negative polarity of the power source 200 is coupled to the polishing platen 101 which becomes negatively charged. Consequently, an electric field (marked with dotted arrows) is formed between the electrode 1051 and the polishing platen 101. The electric field directs downward the polishing platen 101. The abrasive particles 201, 202 then move towards the electrode 1051 and are adsorbed by the electrode 1051 by the attraction of opposite charges.

In an embodiment, the power source 200 includes a voltage ranging from about 0V to about 30V. Preferably, the power source 200 has a voltage of about 8V.

In an embodiment, the electrode 1051 of the polarity changer 105 may include conductive materials such as copper, aluminium, tungsten, and the like. The electrode 1051 may include non-conductive materials, and further be coated with a metal film to allow the electrode 1051 to have electrical conductivity. Alternatively, the electrode 1051 may include conductive materials, and further be coated with an insulating film, such as Polytetrafluoroetylene (Teflon) or silicon carbide, so as to avoid introducing other pollution source. The electrode 1051 may have a symmetrical shape of cylinder or elongated rod, or other asymmetrical shapes, which aims to adsorb the abrasive particles 201, 202 that are immersed in the polishing slurry. In an example embodiment, the electrode 1051 may be made of copper, which is elongated rod shaped and has a length of about 100 mm.

In an embodiment, the polarity changer 105 may be immobile at a position in the polishing slurry 104, while the polishing platen 101 rotates relatively to the polarity changer 105, so that a certain region in the polishing slurry 104 may be scanned by the electrode 1051. Alternatively, the polarity changer 105 may scan back and forth in the polishing slurry 104, so as to adsorb more abrasive particles 201, 202 quickly of a relatively greater region in the polishing slurry 104. However, it should be noted that the polarity changer 105 may not be configured in contact with the wafer 103.

Figure 8:
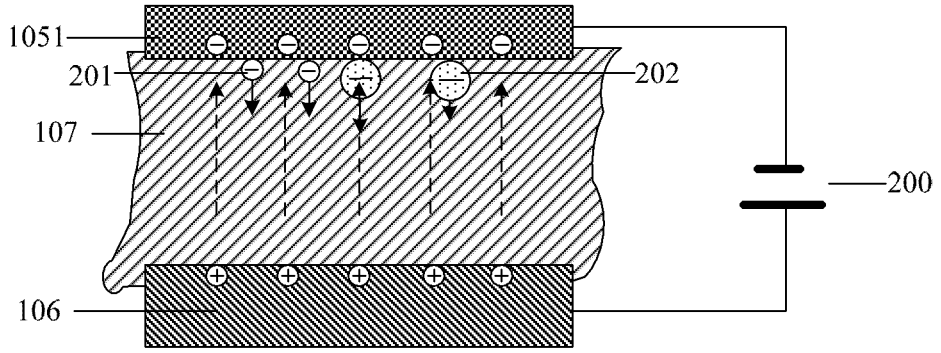

Referring to FIG. 8, the polarity changer 105 which has adsorbed abrasive particles 201, 202 rotationally moves from the polishing slurry 104 to the cleaning device 106, in order that the abrasive particles 201, 202 may be removed. The cleaning process mainly includes the following steps. The polarity changer 105 which has adsorbed abrasive particles 201, 202 rotationally moves to the cleaning device 106. The cleaning device 106 contains an alkaline solution 107 such as potassium hydroxide (KOH), ammonia water, and the like. The alkaline solution 107 may include a PH value ranging from about 7 to about 12. Therefore, the abrasive particles 201, 202 immersed in the alkaline solution 107 are negatively charged. The power source is disconnected to the polarity changer 105 and the polishing platen, the negative polarity of which is then connected to the polarity changer 105, and the positive polarity of which is connected to the cleaning device 106, so that the electrode 1051 is negatively charged, whereas the cleaning device 106 is positively charged. Consequently, an electric field (marked with dotted arrows) is formed between the electrode 1051 and the cleaning device 106, which directs upward the polarity changer 105. The abrasive particles 201, 202 which are negatively charged may be cleared away from the electrode 1051 by the repellence of identical charges, and move to the cleaning device 106. Accordingly, the electrode 1051 of the polarity changer 105 is cleaned up so as to proceed to adsorb the abrasive particles 201, 202 generated between the wafer 103 and the fixed abrasive polishing pad 102 in a next polishing process.

In conclusion, in the embodiments of the present invention, the abrasive particles 201, 202 generated in the polishing process are negatively charged in a polishing slurry which includes an alkaline solution. The polarity changer 105 rotationally moves to a position above the fixed abrasive polishing pad 102, which brings the electrode 1051 into contact with the polishing slurry 104. Positive polarity of the power source 200 is connected to the polarity changer 105 which becomes positively charged. Negative polarity of the power source 200 is connected to the polishing platen 101 which becomes negatively charged. The abrasive particles 201, 202 having negative charges move towards the electrode 1051 having positive charges, so that the abrasive particles 201, 202 are adsorbed by the electrode 1051 by the attraction of opposite charges. Afterwards, the polarity changer 105 which has adsorbed abrasive particles 201, 202 rotationally moves to the cleaning device 106. The power source 200 supplies reverse voltage to the polarity changer 105 and the cleaning device, allowing the electrode 1051 to be negatively charged, and the cleaning device 106 to be positively charged. The abrasive particles 201, 202 which have been adsorbed by the electrode 1051 may be cleared away from the electrode 1051 by the repellence of identical charges, and move to the cleaning device 106. Accordingly, the electrode 1051 of the polarity changer 105 is cleaned for the purpose of the subsequent use. Compared with the prior art, the solutions provided in the embodiments of the present invention can effectively prevent the wafer from being damaged and scraped caused by the abrasive particles generated during the polishing process, thereby increasing wafer yield and improving efficiency of the polishing.

The polishing method according to the embodiments of the present invention can be applied to any fixed abrasive polishing process, such as STI (shallow trench isolation) CMP, and polishing a metal layer including copper or tungsten.

Although the present invention has been disclosed above with reference to preferred embodiments thereof, it should be understood that the invention is presented by way of example only, and not limitation. Those skilled in the art can modify and vary the embodiments without departing from the spirit and scope of the present invention.

What is claimed is:

1. A polishing method, comprising:

mounting a wafer on a fixed abrasive polishing pad located on a polishing platen;

delivering a polishing slurry to the fixed abrasive polishing pad to polish the wafer;

providing a polarity changer having an electrode mounted at one end of the polarity changer, wherein the polarity changer allows the electrode to have a polarity reversible between being positively charged and being negatively charged;

moving the polarity changer relatively to the polishing platen to a position above the fixed abrasive polishing pad, such that a region in the polishing slurry is scanned by the electrode when moving the polarity changer; and adsorbing, when the region in the polishing slurry is scanned by the electrode, abrasive particles generated during the polishing process with the electrode, wherein the electrode is in contact with the polishing slurry and has the polarity opposite to a polarity of charges of the abrasive particles.

2. The method according to claim 1, wherein the polishing slurry comprises one or more materials selected from a group consisting of proline, alanine, and glycine.

3. The method according to claim 1, wherein the polishing slurry has a PH value ranging from about 10 to about 11.

4. The method according to claim 1, wherein the abrasive particles comprise silica particles or ceria particles.

5. A polishing device, comprising:

a polishing platen;

a fixed abrasive polishing pad located on the polishing platen, wherein the fixed abrasive polishing pad is configured to mount a wafer for polishing;

a slurry pipeline for transmitting a polishing slurry to the fixed abrasive polishing pad in a polishing process for polishing the wafer;

a polarity changer having an electrode mounted at one end of the polarity changer, wherein the polarity changer allows the electrode to have a polarity reversible between being positively charged and being negatively charged, wherein the polarity changer is configured movable relatively to the polishing platen to a position above the fixed abrasive polishing pad during the polishing process for the electrode to scan a region in the polishing slurry to absorb abrasive particles generated during the polishing process; and wherein the polarity changer is out of contact with the fixed abrasive polishing pad and the electrode is in contact with the polishing slurry when the electrode is in operation.

6. The device according to claim 5, further comprising a cleaning device and a power source, wherein the cleaning device is fixed to one side of the polishing platen via a base and is coupled to one end of the power source via a switch, and the polarity changer is coupled to the other end of the power source via the switch.

7. The device according to claim 6, wherein the power source comprises a voltage ranging from about 0V to about 30V.

8. The device according to claim 6, wherein the electrode comprises non-conductive materials.

9. The device according to claim 8, wherein the surface of the electrode is coated with a metal film.

10. The device according to claim 6, wherein the electrode comprises conductive materials.

11. The device according to claim 10, wherein the surface of the electrode is coated with an insulating film.

12. The device according to claim 6, wherein the electrode has a shape of cylinder or elongated rod.

13. The device according to claim 6, wherein the polishing slurry transmitted by the slurry pipeline comprises an alkaline solution.

14. The device according to claim 6, wherein one end of the power source is coupled to the polarity changer via the switch, and the other end of the power source is coupled to the polishing platen via the switch when the electrode is in operation.

* * * * *